United States Patent [19]

Noé et al.

[11] Patent Number: 4,558,578

[45] Date of Patent: Dec. 17, 1985

[54] METHOD OF AND APPARATUS FOR MAKING THIN METAL STRIP

[75] Inventors: Oskar Noé, Mühlheim-Ruhr; Rolf Noé, Berlin-Charlottenburg; Andreas Noé, Aachen-Richterich, all of Fed. Rep. of Germany

[73] Assignee: BWG-Bergwerk- und Walzwerk-Maschinenbau GmbH, Duisburg, Fed. Rep. of Germany

[21] Appl. No.: 442,763

[22] Filed: Nov. 18, 1982

[30] Foreign Application Priority Data

Feb. 3, 1982 [DE] Fed. Rep. of Germany ..... 3203581

[51] Int. Cl.[4] ..... B21B 45/06; B21B 15/00; B21B 39/08

[52] U.S. Cl. ..... 72/39; 72/161; 72/203; 72/205

[58] Field of Search ..... 72/39, 41, 127, 129, 72/130, 203, 205, 226, 227, 366, 204, 161

[56] References Cited

U.S. PATENT DOCUMENTS

| | | | |
|---|---|---|---|
| 3,918,282 | 11/1975 | Eibe | 72/39 |
| 4,347,723 | 9/1982 | Bradlee | 72/203 |

FOREIGN PATENT DOCUMENTS

| | | | |
|---|---|---|---|
| 44-24241 | 10/1969 | Japan | 72/39 |
| 51-20754 | 2/1976 | Japan | 72/204 |
| 51-94453 | 8/1976 | Japan | 72/203 |
| 139201 | 10/1981 | Japan | 72/203 |
| 1543284 | 4/1979 | United Kingdom | 72/203 |
| 827204 | 5/1981 | U.S.S.R. | 72/205 |

OTHER PUBLICATIONS

Lyman, T., Editor, Metals Handbook, 8th Edition, vol. 4, Forming, pp. 271–272.

*Primary Examiner*—E. Michael Combs
*Attorney, Agent, or Firm*—Karl F. Ross; Herbert Dubno

[57] ABSTRACT

Hot-rolled metal strip is pickled and then, before oiling and coiling, is subjected to a rolling operation of the skin-pass and/or bend-leveling type. If the strip is to be longitudinally split in half, the rollers of the skin-pass assembly—which preferably consists of two stages—may include a substantially barrel-shaped roller pair designed to impart a symmetrical cross-section to each of the two strip halves.

12 Claims, 7 Drawing Figures

PRIOR ART

METHOD OF AND APPARATUS FOR MAKING THIN METAL STRIP

FIELD OF THE INVENTION

Our present invention relates to a process and an apparatus for treating a thin, hot-rolled metal strip after pickling.

BACKGROUND OF THE INVENTION

It is known to produce metal strip by hot-rolling slabs down to a thickness of at most 1 mm. Only a small part of the metal strip produced in this manner can be used directly, that is without subsequent pickling and further treatment such as surface-finishing (known in the art as temper rolling or skin passing) and leveling. The pickling removes roll scale and entails passing the hot strip continuously or discontinuously through an appropriate acid bath.

In a continuous pickling operation lengths of strip are welded together at their ends at the intake of the pickler and cut apart at the downstream end to avoid having to stop the strip in the bath. For the short periods that the strip must be stationary to carry out these joining and separating operations loopers such as described in our commonly owned copending application Ser. No. 169,493 filed July 15, 1981, now U.S. Pat. No. 4,360,137, are provided so that the strip in the bath keeps moving.

In order to thoroughly pickle the hot-rolled strip it is standard to use rolling setups, typically roller-type bend-levelers, immediately before the chemical treatment, that is upstream of the pickling bath. Such mechanical treatment loosens the mill scale so that the pickle can attack it.

Downstream of the pickling bath the clean strip metal is given a rust-preventing coating. Typically grease or thin oil is sprayed over the strip to seal its surface. The strip is then rolled up and the coils are either used as is or further treated, for example leveled, finished, and trimmed, in other locations.

Nowadays it is standard to hot-roll metal strip down very thin, to about 1 mm which is considered the minimum possible thickness. Such strip must be flattened and surface-finished. Bend-leveling is the preferred finishing operation for evening out thickness variations and eliminating anisotropisms in the plane of the workpiece. The resultant product is tough and ductile.

A problem with this style of production is created by the rust-preventing oil film. It makes gripping the strip difficult, and builds up at the rollers. Hence it is necessary to clean the strip, normally by passage through a solvent bath or spray, before such a finishing operation.

Another difficulty in the mass production of hot-rolled metal strip is that it is typically done in a standard rolling string having a width capacity of about 2.2 m. If the initial strip width is reduced to, say, 800 mm, this will underutilize the hot-rolling string laid out for more than twice that width.

It has been suggested to roll a slab about 1650 mm wide and then to split the strip so that the hot-rolling equipment is fully utilized. Unfortunately, since the strip that exits from the hot-rolling string is usually thicker in the center than at the edges, such splitting is fairly difficult and yields strips that are much thicker at one edge than at the other, a shape making downstream guiding of them quite difficult. As a result this procedure has met with no commercial acceptance.

OBJECTS OF THE INVENTION

It is therefore an object of our present invention to provide an improved process and apparatus for producing hot-rolled metal strip which overcomes the aforementioned disadvantages.

A further object is to finish hot-rolled strip, normally of steel, in a manner that fully utilizes the hot-rolling equipment even if the final strip width is to be less than half that which can be handled by this equipment.

SUMMARY OF THE INVENTION

In accordance with our instant invention, the conventional strip-production process is modified by subjecting the hot-rolled and then pickled strip to an aftertreatment immediately following the pickling, that is without intermediate oiling and storage. The term "aftertreatment" here includes surface-finishing and/or bend-leveling as described above, involving in either case a pass between several rollers engaging opposite strip surfaces.

Such a procedure eliminates the necessity of oiling, then cleaning before the roller treatment and thereafter reoiling the strip. This greatly simplifies and rationalizes the strip-production process. When the strip need merely be flattened, the bend-leveling can be dropped, and when it need merely be tough and level but the surface need not be of high quality, the surface-finishing can be eliminated.

The surface-finishing here contemplated, known as skin pass, normally makes deep-drawing of the finished strip more difficult. We have surprisingly discovered that surface-finishing followed by bend-leveling, immediately after pickling according to the instant invention, restores and even improves the ability of the sheet metal to be deep drawn.

According to another feature of this invention, as the strip is being rolled after pickling it is formed with a longitudinally extending central region of reduced thickness flanked laterally by regions of greater thickness. Thereafter the strip is split at the central region into two identical strip halves that are each of lozenge section, i.e. symmetrical about respective longitudinally extending center planes. Such a procedure allows the full width of the hot-rolling string and pickling unit to be used. The two narrower strips that are thus produced can be guided and further used with ease.

It is also possible to subject the strip to a conventional pre-leveling operation before it is pickled. This increases the effectiveness of the pickling, as noted above.

The strip according to this invention is oiled after it has been roller-treated. When it is split as described above, the oiling is done in the subsequently described embodiment after the splitting and before the strip is coiled up for storage and/or transport.

The apparatus according to our invention may have barrel-shaped rollers in the aftertreatment stage, specifically in the skin-pass assembly as described hereinafter. These rollers therefore centrally groove the strip. A rotary-action shear then splits the thus grooved strip.

In order that the machine does not have to be shut down when rollers are changed, the aftertreatment unit advantageously includes two separate skin-pass stages in cascade. Such double surface treatment also improves the resulting product.

BRIEF DESCRIPTION OF THE DRAWING

The above and other features of our invention will become more readily apparent from the following detailed description, reference being made to the accompanying drawing in which.

SPECIFIC DESCRIPTION

Figure 1:
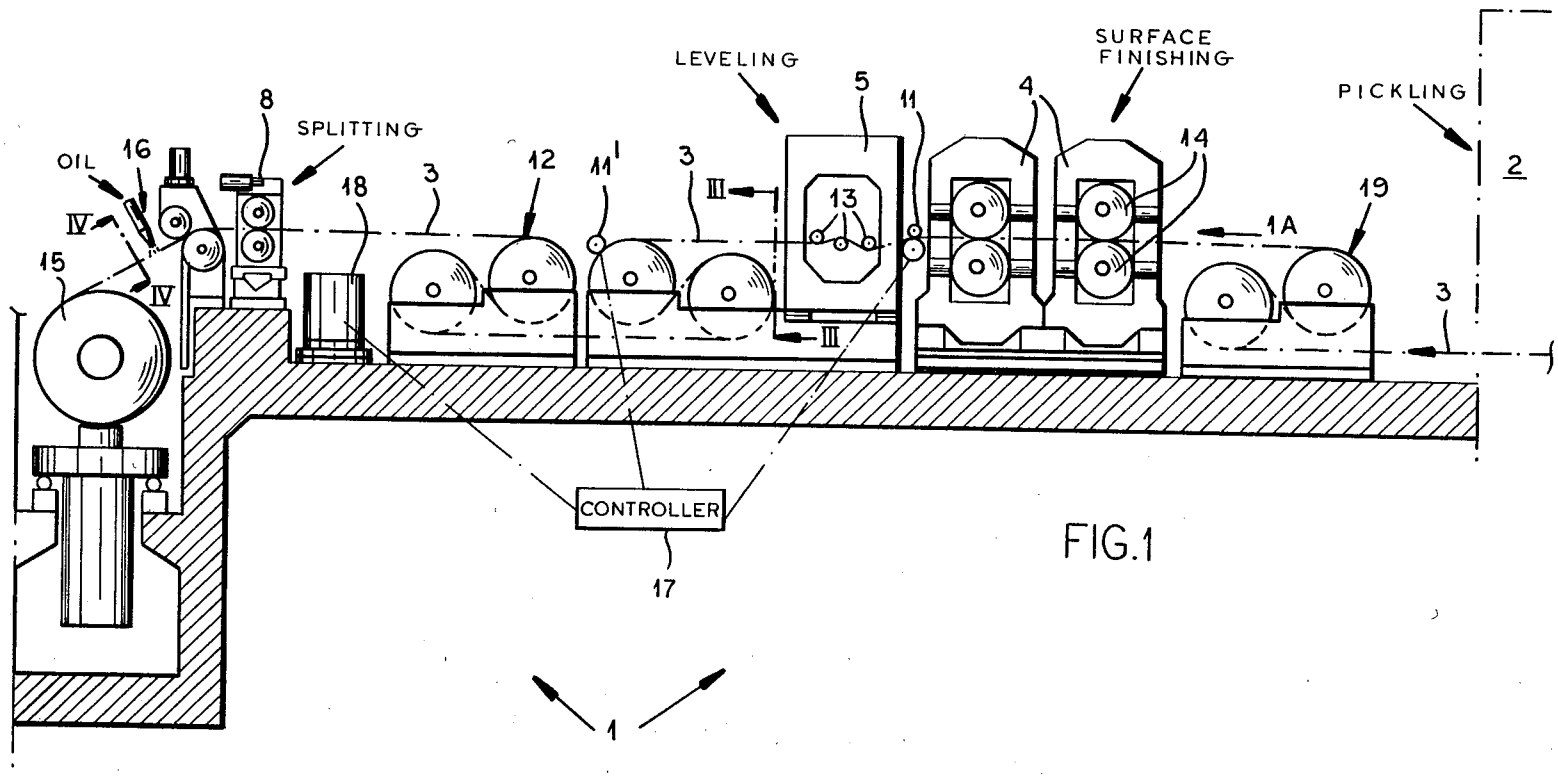
FIG. 1 is a partly diagrammatic and partly longitudinally sectional view of an apparatus for carrying out the method of this invention.

As seen in FIG. 1, an exit section 1 of a pickling line 2 receives hot-rolled strip 3 of about 1 mm thickness and about 1650 mm width. A pickling apparatus such as described in commonly owned copending patent application Ser. No. 426,066 filed by us jointly with another on Sept. 28, 1982, with straight-through strip travel, can be used for the pickler 2. The strip 3 passes in the unit 1 through a pair of cascaded surface finishers 4 of the skin-pass type and through a roller-type leveler 5 of standard construction. Thus, immediately as the strip 3 exits from the acid bath of the pickler 2 its surface is finished and leveled.

Figure 2:
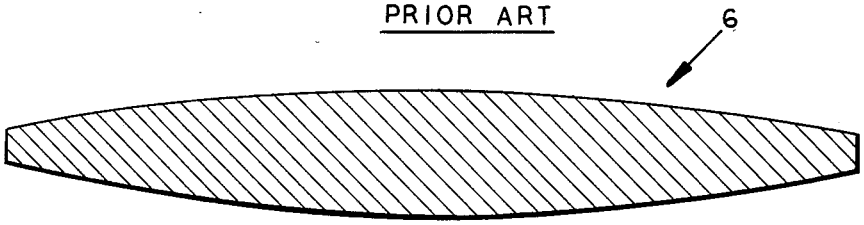
FIG. 2 is a cross-section through a standard hot-rolled steel strip.

A prior-art strip 3 would have the shape shown at 6 in FIG. 2 as it leaves the leveler 5, since such a leveler would normally have cylindrical strip-bracketing rollers that bow apart somewhat in the middle.

Figure 1A:
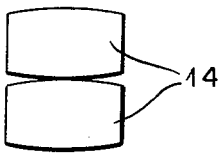
FIG. 1A is a large-scale detail view taken in the direction of arrow IA of FIG. 1.
Figure 3:
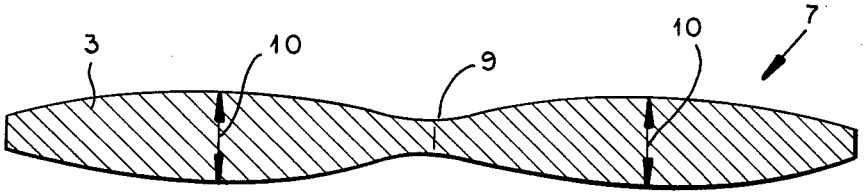
FIG. 3 is a large-scale section like FIG. 2, taken along line III—III of FIG. 1.

According to a feature of our invention, the large-diameter rollers 14 of the finishers 4 are barrel-shaped as shown in FIG. 1A. This imparts to the strip 3 the cross section shown at 7 in FIG. 3, that is with a waisted narrow central region 9 flanked by two thick regions 10.

Figure 4:
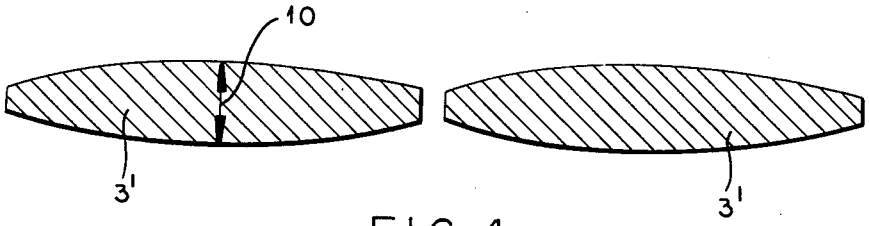
FIG. 4 is a large-scale section taken along line IV—IV of FIG. 1 through the strip.

A central shear 8 provided at the downstream end of the unit 1 splits the strip 3 at the region 9 and separates it into two like strips 3' of about 800 mm width as seen in FIG. 4. These strips 3' are then sprayed with oil at a station 16 and wound up in coils 15. Thus, as illustrated in FIG. 5, the strip is sequentially hot-rolled, pickled, surface-finished, leveled, split, oiled and coiled.

Figure 5:
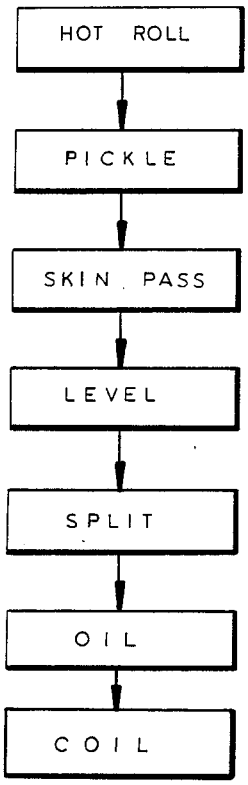
FIG. 5 is a block diagram illustrating the method of FIG. 1.
Figure 6:
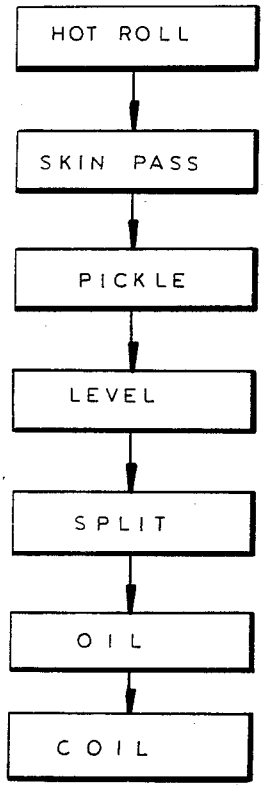
FIG. 6 is a block diagram of another method according to this invention.

It is also possible, as shown in FIG. 6, to skin-pass the strip after hot-rolling but before pickling, and then to level, split, oil and coil it as in FIGS. 1 and 5.

The strip 3 gets longer as it is surface-finished at 4 and bend-leveled at 5. To this end a sensing wheel 11 ahead of the two-stage leveler 5 is connected to a controller 17 that is connected in turn to the drive 18 of a so-called speedmaster or bridle 12 between the leveler and splitter 8. Another sensing wheel 11' engages the strip downstream of the leveler 5 so that the controller 17 can operate the downstream bridle 12 at a speed greater than that of an upstream bridle 19 to keep the strip 3 taut.

With this system it is therefore possible to produce high-quality metal strip with a minimum number of steps.

We claim:

1. In the process of producing a thin, hot-rolled metal strip from a starting metal slab of substantial thickness, wherein (i) the starting metal slab is passed through a hot-rolling mill and thereat is rolled down and transformed into a metal strip the thickness of which is substantially the lowest attainable thickness for the strip, and (ii) the resultant strip, upon leaving the hot-rolling mill, is passed through a pickling line including a main section providing a pickling bath and an adjoining exit section; the improvement consisting essentially of the steps of:

(a) immediately after the pickled strip leaves the pickling bath subjecting the pickled strip, while the same is under tension in the exit section of the pickling line and without being first oiled and/or coiled, to a composite aftertreatment consisting, in sequence, of a skin-pass operation followed by a bend-leveling operation both performed by rollers engaging the opposite surfaces of the strip; and (b) thereafter coiling the aftertreated strip.

2. A process as defined in claim 1 wherein the strip is oiled between steps (a) and (b).

3. A process as defined in claim 1 wherein said skin-pass operation is carried out in two cascaded roller stages.

4. A process as defined in claim 1 wherein the strip is longitudinally split into two halves between steps (a) and (b).

5. A process as defined in claim 4 wherein the skin-pass operation of step (a) includes passing the strip between coacting convex rollers shaped to reduce the thickness of the strip along a centerline thereof while imparting a substantially symmetrical convex cross-section to each strip half flanking said centerline.

6. A process as defined in claim 4 wherein the strip is oiled between the splitting and coiling steps.

7. A process as defined in claim 1 wherein the thickness of the hot-rolled strip passing through the exit section of the pickling line is on the order of 1 mm.

8. In an apparatus for producing a thin, hot-rolled metal strip from a starting metal slab of substantial thickness, wherein (i) the starting metal slab is passed through a hot-rolling mill and thereat is rolled down and transformed into a metal strip the thickness of which is substantially the lowest attainable thickness for the strip, and (ii) the resultant strip, upon leaving the hot-rolling mill, is passed through a pickling line including a main section providing a pickling bath and an adjoining exit section; the improvement comprising:

bridle means operable to engage the pickled strip for drawing the same under tension through said exit section;

an aftertreatment unit disposed immediately downstream of said pickling bath in said exit section, there being no means for oiling and/or means for coiling the pickled strip interposed between said pickling bath and said exit section, said unit including a skin-pass assembly with at least one roller pair bracketing the strip between them and further including a bend-leveling assembly following said skin-pass assembly; and windup means downstream of said exit section for coiling the aftertreated strip.

9. An apparatus as defined in claim 8 wherein the rollers of each said roller pair are substantially barrel-shaped for reducing the thickness of the strip along a centerline thereof while imparting a substantially symmetrical convex cross-section to each strip half flanking said centerline, and strip-splitting means are disposed between said unit and said windup means for severing the two strip halves along said centerline.

10. An apparatus as defined in claim 8 wherein said skin-pass assembly includes two cascaded roller pairs bracketing the strip between them.

11. An apparatus as defined in claim 8, wherein an oiling station is inserted between said unit and said windup means.

12. An apparatus as defined in claim 8 wherein the thickness of the hot-rolled strip passing through the exit section of the pickling line is on the order of 1 mm.

* * * * *